United States Patent [19]

Heath

[11] 4,411,290

[45] Oct. 25, 1983

[54] BOTTOM LOADING ARM FOR BULK LIQUID CARRIERS

[75] Inventor: Warren A. Heath, Sunnyvale, Calif.

[73] Assignee: Chevron Research Company, San Francisco, Calif.

[21] Appl. No.: 273,309

[22] Filed: Jun. 15, 1981

[51] Int. Cl.[3] ..... B65B 3/04

[52] U.S. Cl. ..... 137/615; 141/279

[58] Field of Search ..... 137/615, 355.16; 141/387, 279; 248/75, 81

[56] References Cited

U.S. PATENT DOCUMENTS

| | | | |
|---|---|---|---|
| 3,620,268 | 11/1971 | Paddington | 141/279 |
| 4,290,463 | 9/1981 | DeGeorge et al. | 137/615 |

FOREIGN PATENT DOCUMENTS

| | | | |
|---|---|---|---|
| 1051119 | 2/1959 | Fed. Rep. of Germany | 137/615 |
| 597495 | 11/1925 | France | 141/279 |
| 7405638 | 2/1975 | Netherlands | 137/615 |

*Primary Examiner*—A. Michael Chambers

*Attorney, Agent, or Firm*—Burns, Doane, Swecker & Mathis

[57] ABSTRACT

A bottom loading arm for bulk liquid carriers, such as gasoline tank trucks, is disclosed. In accordance with the invention, a single continuous reinforced flexible loading hose extends horizontally over large radius arcs from a vertical supply standpipe to a pendant bulk carrier connector. The arrangement is held in such large arcs by a pair of pivot arm means mounted for vertical and horizontal pivotal motion on the standpipe. One of the pivotal arm means is supported by horizontal arm means horizontally rotatable on the standpipe. The other pivotal arm means in turn is pivotally mounted at the outer or forward end of the first pivotal arm means. A vertically pendant portion of the flexible loading hose and the carrier connector is thus supported from the pendant end of the other pivotal arm means. The pivot arm means, hose and connector are counterbalanced by counterweight means supported on the other end of the first pivot arm means which extends rearwardly beyond the standpipe. The arrangement permits ready accommodation to load tanks of tank trucks on either side of the standpipe at high loading rates without use of rigid pipe sections and multiple swivels susceptible to mechanical damage with resulting leakage, and with reduced manual effort to couple the hose connector to the tank truck valve or manifold.

5 Claims, 5 Drawing Figures

BOTTOM LOADING ARM FOR BULK LIQUID CARRIERS

TECHNICAL FIELD

The present invention relates to apparatus for transferring bulk liquids between a storage tank and a bottom loading carrier, such as a tank truck. More particularly, it relates to an improved bottom loading "arm" for transferring gasoline, diesel fuel and the like from a standpipe located on a loading dock or "island" to a tank truck on either side of the island. It is a particular object of the invention to provide a rugged, low maintenance unitary flexible conduit arrangement supported over arcs having large radii of curvature to run from a rotatable overhead standpipe elbow to a bulk liquid carrier connector to be coupled to the bottom loading valve of a tank truck, without use of pressure-tight swivel joints for vertical articulation and for minimum use for horizontal reach.

To satisfy requirements of the American Petroleum Institute specification for such a loading system, the connector must be movable over a volume ("envelope") 8 feet long and 3.5 feet high, with the centerline of the connector 2.25 feet above grade, and at a distance of from 6 feet to 10 feet laterally from the center line of a standpipe on the island. For practical utility, the loading arm must service such an envelope on both sides of a loading island. This is so that while a tank truck on one side is being loaded, another tank truck on the other side can be docked and prepared to load or to load a different product.

PRIOR ART

Bottom loading arms have been in general use for loading bulk carriers such as gasoline or diesel tank trucks, at ground level, for the past decade. Such loading arms involve flow lines or conductors 3" to 4" in diameter to permit flow at rate of several hundred gallons per minute at pressures on the order of 75 psi (excluding shock). Such large diameters, pressures and flow rates combined with the need to service the API envelope for connection to valves on different makes and models of carriers places continuous loads on the usual multiple articulate pipe joints, or swivels, commonly used to accommodate such connections. Prevention of leakage of such swivel joints is a high cost operation and leakage, in general, violates air, land and water pollution standards in many jurisdictions.

U.S. Pat. No. 3,989,065—McTighe illustrates one form of such a bottom loading arm in which a plurality of rigid pipe sections articulate relative to each other. A plurality of swing joints or swivels accommodate the API envelope within the limits imposed by the respective lengths of the rigid pipe sections. Such swivels include glands which must be kept in close adjustment to permit easy movement of the pipe sections, but without leakage. Swivels of this type are costly to manufacture and require regular maintenance, even when carefully handled.

U.S. Pat. No. 3,587,643—Bahr et al. discloses another form of such a bottom loading arm wherein an overhead rigid conductor arm is connected to a vertical standpipe through a swivel or universally flexible joint. The conductor is counterweighted to support the rigid horizontal conductor and a rigidly connected dependent conductor for supporting a vertical section of a flexible meatal hose carrying the tank truck connector.

A system similar to the Bahr et al arrangement has been used commercially for the past decade in which both the swivel joints and counter weights are omitted. Such a system depends upon a flexible hose being sufficiently long to accommodate the API envelope. This generally results in the pressure connector resting on the loading ramp. Due to its bulk and weight, the user encounters the hazards of both lifting such a weight and possibly dropping it. Further, the "reach" of such an overhead arm must be kept short to permit use of a rotatable elbow of reasonable size and cost of the standpipe, and the seal for the rotatable connection, within allowable deflection limits of standpipe and rotatable elbow.

It has also been known to use overhead, articulated arms for supporting hoses for dispensing compressed air to fill automotive tires. Examples of such air hose supports are described in U.S. Pat. Nos. 1,374,803—Asquith; 1,412,100—Canaday; 1,446,648—Kostlan; and 1,712,176—Stirdivant. In each of these systems, no swivel joints are required and the hose extends from a turn-off valve arrangement near ground level to the dispensing valve. The hose either runs through loops or in guide tubes or conduits. In such systems, any resulting leaks from the hose are only a nuisance, not a pollution problem. Since the pressures and flow rates do not require massive connections for dispensing air to the tires, only the weight of the hose itself need be supported. Further, at such low pressures, non-reinforced hose easily coils or turns without mechanical help.

In accordance with the present invention, my simplified structure of a bottom loading arm is characterized by extending the flexible conductor over arcs of large radii of curvature (relative to the diameter of the conductor) from an elbow, rotable on a vertical standpipe, to the bottom loading bulk carrier connector with only a single support for the pendant portion of the flexible conduit and connector. Such construction does not require the use of multiple swivels, with their concommitent problems, but provides for greater ease of movement of the massive carrier connector over the entire API envelope without special docking or redocking of the tank truck. Large radius arcs of the fully flexible conduit are created by a pair of articulated, or pivot, arm members extending from the horizontal connection at the standpipe elbow to the generally vertical, pendant portion. One such arm is supported for substantially vertical pivot motion and the other arm for horizontal, and partial (approximately 45 degrees) vertical, pivot motion. One end of the latter arm is supported to pivot near the end of the first arm that is remote from the standpipe. The pivot arm assembly, (including both arms) is pivotally supported by a horizontal arm member rigidly secured to the supply standpipe elbow so that the entire assembly, including the flexible conductor and pivot arm assembly rotate about the standpipe centerline. The pivot point carried by the horizontal arm member is sufficiently forward of the connection between flexible conductor and the standpipe elbow to provide a first long radius of curvature for vertical flexing of the flexible conductor. Such flexing at the elbow occurs during hookup of the carrier connector to the truck valve due to rotation of the substantially horizontal pivot arm by vertical movement of the carrier connector and the flexible conduit thereabove. Simultaneously, the approximately 90 degree turn of the flexible conductor from horizontal to vertical is over a similarly large radius of curvature formed by the lengths of the horizontal pivot arm and the vertical pivot arm. A counter weight on the opposite end of the horizontal pivot arm member permits ready adjustment of the vertical position of the carrier connector.

Further objects and advantages of the present invention will become apparent from the following detailed description, taken with the drawings, of a preferred embodiment of the invention.

BEST MOSE FOR CARRYING OUT INVENTION

Figure 1:
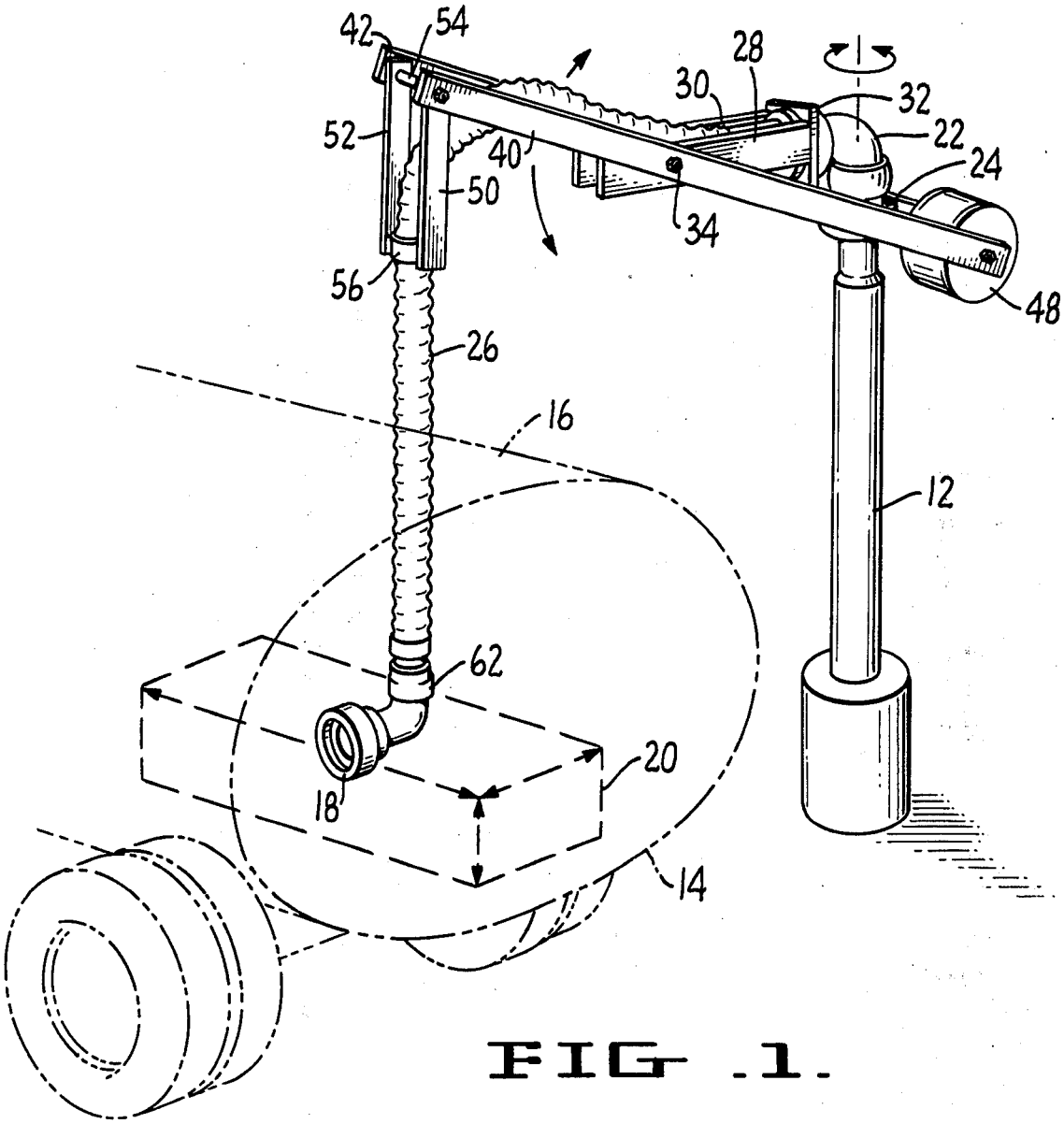
FIG. 1 is a perspective view of a bottom loading arm for filling a liquid bulk carrier, having a tank connection within the limited envelope, from a standpipe adapted to service parallel loading docks.
Figure 2:
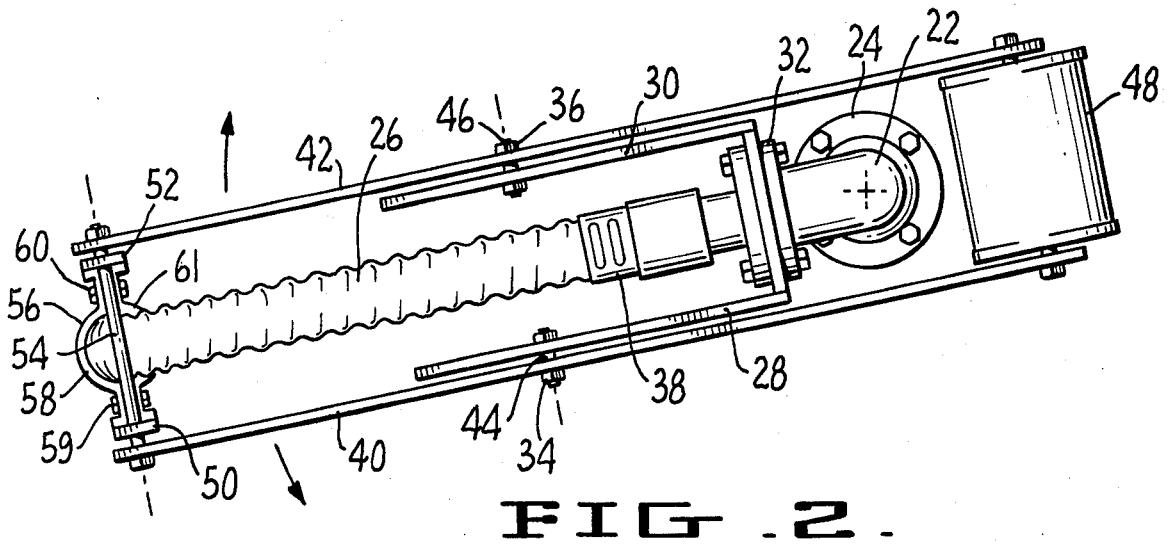
FIG. 2 is a top plan view of the loading arm, which particularly shows connection of the flexible loading conductor to the standpipe rotatable elbow and the support means for the pendant portion of the flexible conductor.

Referring not to the drawings, FIG. 1 illustrates a bottom loading arm constructed in accordance with the present invention. An essential feature of such a structure, as shown, includes a vertical standpipe 12 adapted to be connected to a liquid storage tank (not shown) by way of underground lines. Standpipe 12 is normally one of several such standpipes located in an island, or dock, which permits a bulk liquid carrier, such as tank truck 14, to be parked and loaded on either side of standpipe 12. Further, the bottom loading valve (not shown) on truck 14 is usually one of two or three arranged in a manifold below the tanks, indicated as 16. Such a tank generally has several compartments for different products, for example, diesel fuel, different grades of regular (tetraethyl lead containing) or, unleaded gasolines. Differences in dimensions and arrangements of valves in the truck manifold require that the bottom loading arm connector means, such as pressure connector 18, accommodate an envelope, or volume, 20. In the case of bulk fuel carriers of gasoline or diesel fuel, this envelope is prescribed by A.P.I. specifications RP 1004, as given above.

To permit the bottom loading arm to service a truck 14 on either side of standpipe 12, the complete assembly rotates up to about 270° and desirably by either clockwise or counterclockwise rotation. Accordingly, elbow means 22 is rotatably mounted on the upper end of standpipe 12 through a flange 24. The stiffness of standpipe, or riser, 12 is sufficient to permit such rotation to be free with a small amount of off-axis load, imposed by the weight of the loading arm, as will be described below.

As particularly distinguished from prior known bottom loading arms, flexible conductor 26 is directly connected to elbow 22 adjacent the axis of standpipe 12. In the preferred embodiment, conductor 26 is a high quality, wire or fabric reinforced rubber pressure hose, in a continuously corrugated configuration over large radii of curvature from elbow 22 to connector 18. Such configuration permits bending of conductor 26 over a wide range of angles to accommodate movement of connector 18 to connect axially with the tank valve throughout the desired envelope, with the connector supported entirely on the lower end of conductor 26 and in accordance with the present invention.

Figure 3:
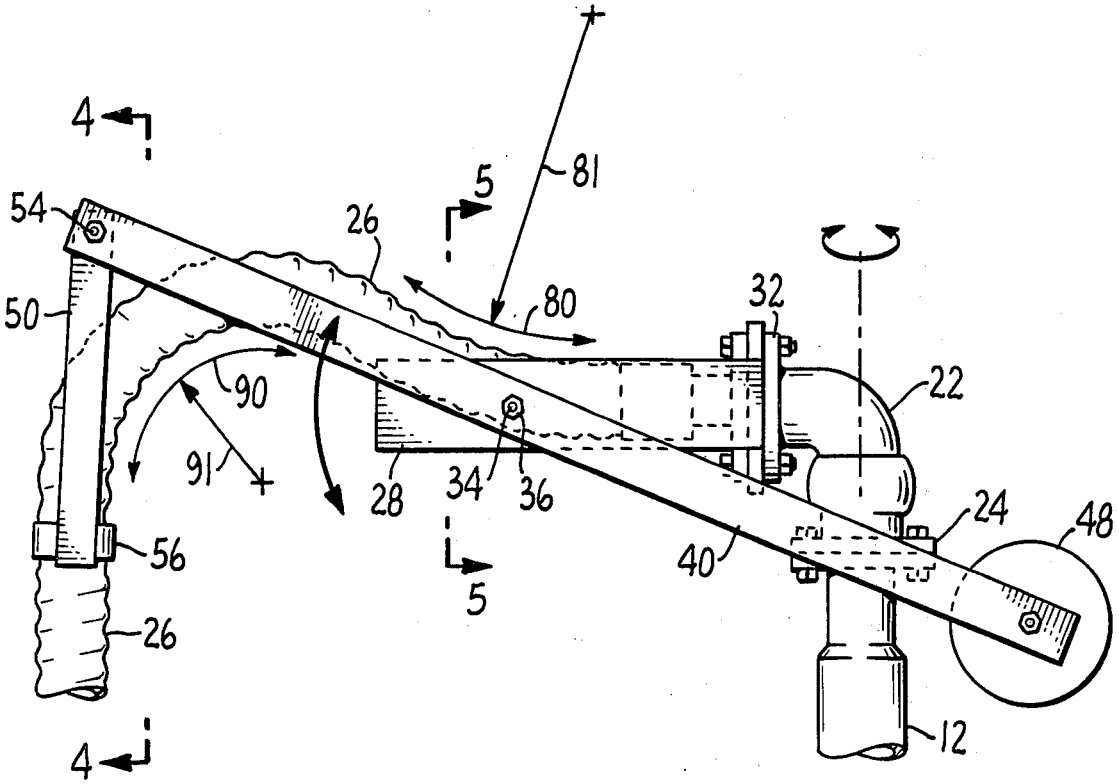
FIG. 3 is a partial, side elevation view of the apparatus of FIG. 1 showing the flexible conductor support means, including the two pivot arm members and the horizontal arm member.

The wide range of angles and displacements of connector 18, as indicated, is accomplished without mechanical piping, or the need for potential leaking swivels other than an easily accessible single swivel 62, at the loading coupler. This is made possible by a pair of parallel horizontal arm members 28 and 30 and secured to extending flange 32 along opposite sides of conductor 26 of elbow 22. Arm members 28 and 30 thus parallel that portion of elbow 22 at a right angle to standpipe 12. Arms 28 and 30 are the primary support means for the unbalanced portion of the loading arm through pivots 34 and 36, respectively. The location of pivots 34 and 36 on arms 28 and 30 are critical in that they must lie sufficiently forward of connector 38 securing conduit 26 to elbow flange 32 to permit free vertical flexing, both up and down, of conduit 26. FIG. 3 particularly illustrates such flexing of conduit 26 over an arc 80 of large radius 81 as compared to the diameter of conduit, or hose, 26. Similarly, arc 90 subtended by large radius 91 characterizes the transition of conduit 26 from its generally horizontal portion to the pendant vertical portion.

Figure 4:
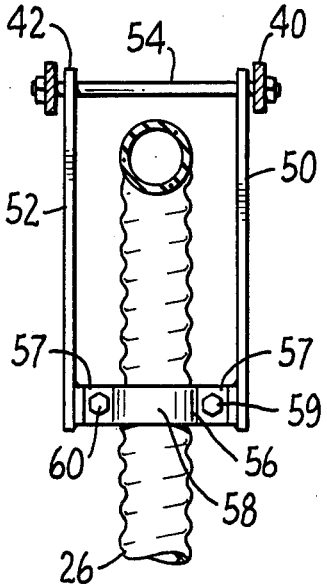
FIG. 4 is a view, partially in cross-section, of the apparatus of FIG. 3, taken in the direction of arrows 4—4.

Actual support of the forward end of the horizontal portion and the pendant portion of conduit 26 is through a pair of pivot arm members 40 and 42 pivotally mounted on pins, or bolts, 44 and 46, respectively. This pivotal connection permits support arms 40, 42 to control vertical movement of conductor 26 and through counterweight 48 to reduce the lever arm effect of carrier connector 18 on the assembly. Further, in accordance with the invention, another pair of pivot arm means 50 and 52 are pivotally supported by crosspin 54 passing through the forwardly extended portions of arms 40 and 42. In this pendant position, the lower end of second pivot arms are secured to flexible conductor 26 by any suitable means, such as adjustable collar clamp 56. As shown in FIG. 4, clamp 56 is secured to conductor 26 by wings 57 on opposite sides of collar member 58 and a pair of bolts 59 and 60. These bolts may thread into a similar collar member 61. Collar 61 is secured, as by welding, to the lower end of pivot arms 50 and 52. Adjustment of conductor in collar members 58 and 61 is through loosening and tightening bolts 59 and 60.

Figure 5:
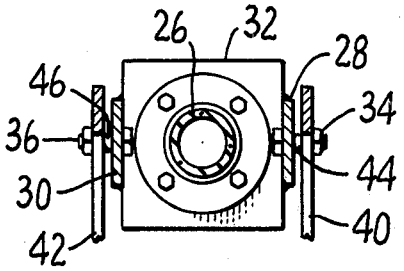
FIG. 5 is a view, partially in cross-section, of the apparatus of FIG. 3, taken in the direction of arrows 5—5.

By the arrangement described, substantially vertical movement of connector 18 is through action of first pivot arms 40 and 42 pivoting about pivot mounts 34, 36, as best seen in FIG. 5. Horizontal motion in the plane define by the axis of flexible conductor 26 and the axis of standpipe 12 is by pivoting the other pivot arm members 50 and 52 about pivot 54 carried by arms 40 and 42. As will be apparent to those skilled in the art, this pair of arms is so dimensioned that they easily and fully cover envelope 20 for service connection of connector 18 to carrier 14 while readily supporting the weight of the depending portion of conductor 26 and carrier connector 18. Connector 18 must withstand high pressure and high flow rates without leakage or loss of product. Such connectors, commonly in use, weigh on the order of 30 to 50 lbs. so that mechanical assistance to lift and lower are essential for worker safety both in connecting and disconnecting coupling 18.

A single swivel connector 62 may be used between connector 18 and flexible conductor 26. However, the flexibility of a corrugated, wire or fabric reinforced rubber conductor or hose, can accommodate (through pivotal action of arms 50, 52 and 40, 42) together with single swivel 62, the slight amount of skew or tilt required to seal the pressure connection between connector 18 and the botton loading valves on tanker 14.

In a commercial form of the invention, for a reach of 5 feet from the centerline of standpipe 12, horizontal arms 28 and 30 may have a length of 30 to 36 inches from coupler 38 to flange 32 of elbow 22 with pivot points 34 and 36 of the same diminsions from the center line of standpipe 12. With these dimensions the radius 81 of arc 80 will be on the order of 2 to 3 feet. Pivot arm means 40, 42 are approximately 7 feet long with the forward portion between pivot points 34, 36 and pivot pin 54 approximately 33 inches; arm 50 and 52 may be 27 inches long to create a radius 91 for arc 90 of about 24 inches. Thus, both radii, 81 and 91, have dimensions of about 2 feet so that with a hose of 3 to 4 inch diameter, such radii are up to 10 times, and preferably to 6 to 8 times, the hose diameter. Flexible conductor 26 in commercial form is available as rubber tank truck hose or bottom loading hose, reinforced by rayon braid with spring steel wire between braids, or helix wires, in a range of diameters from 1½" to 4". A diameter of 3" to 4" is preferred for high loading rates. Such hoses are manufactured by Empex Industrial Hose, Long Beach, Calif. and Goodall Rubber Company, San Francisco, Calif.

While only a single embodiment of the present invention has been shown and described in the above detailed description, changes or modifications in the structure will become apparent to those skilled in the art. All such changes or modifications coming within the scope of the appended claims and their equivalent structure are intended to be included therein.

What is claimed is:

1. A loading arm for bottom loading or unloading of liquid between a storage tank and a bulk liquid carrier, such as a tank truck, which comprises:

a flexible conductor extending generally horizontally from a vertical supply standpipe adapted to be connected to a liquid storage tank;

elbow means, including a first end, rotatably mounted on said vertical supply standpipe and a second end for connecting one end of said flexible conductor to said standpipe;

flexible conductor support means mounted for horizontal rotational movement coaxial with the axis of rotation of said elbow means, said support means including horizontal arm means secured to said elbow means to extend substantially parallel to the axis of said elbow means second end and outwardly from said standpipe;

pivot arm means, said pivot arm means being mounted for vertically pivotal motion on said horizontal arm means, other pivot arm means for supporting the forwardly extending portion of said flexible conductor in a vertical position, said other pivot arm means being mounted for pivotal motion from one end of the first said pivot arm means, and counterweight means supported by the other end of said first pivot arm means and extending rearwardly of said standpipe to counterbalance said flexible conductor, the opposite end of said first pivot arm means, and said other pivot arm means;

means for securing the upper end of the vertically disposed portion of said flexible conductor to the pendant end of said other pivot arm means, and bulk liquid carrier connector means affixed to the other end of said flexible conductor whereby said liquid connector means may be engaged with, and disengaged from said bulk carrier by horizontal rotation of said loading arm assembly about said vertical standpipe and vertical and horizontal movements of said flexible conduit with said one and said other pivotal arm means, respectively.

2. A loading arm in accordance with claim 1 wherein the pivot means supported by said horizontal support means is displaced from the connection of said flexible conduit to said elbow means sufficiently to assure deflection of said conduit relative to said elbow means over an arc having a large radius when said first pivot arm means pivots about said pivot means.

3. A loading arm for bottom loading or unloading of liquid between a storage tank and a bulk liquid carrier, such as a tank truck, which comprises:

a flexible conductor extending generally horizontally outwardly from a vertical supply standpipe connectable to a liquid storage tank;

elbow means, including a first end, rotatably mounted on the upper end of said vertical supply standpipe and a second end for connecting one end of said flexible conductor to said standpipe;

flexible conductor support means mounted for horizontal rotational movement coaxial with the axis of rotation of said elbow means, said support means including horizontal arm means secured to said elbow means extending outwardly therefrom, and substantially parallel to the axis of said elbow means second end;

a first pivot arm mounted for vertically pivotal motion at said horizontal arm means, the position of the pivot print on said horizontal arm means being such that the radius of curvature of said conductor is 4 to 10 times the diameter of said conductor;

second pivot arm means for supporting the most forwardly extending portion of said flexible conductor in a vertical position, said second pivot arm means being mounted for pivotal motion from one end of said first pivot arm means;

means for securing the upper end of said vertical portion of said flexible conductor to the pendant end of said other pivot arm means, the position of the pivotal points on said second pivot arm means and said one end of said first pivot arm means being such that the radius of curvature of said conductor is up to 10 times the diameter of said conductor;

counterweight means supported by the other end of said first pivot arm means and extending rearwardly of said standpipe to counterbalance said flexible conductor, the opposite end of said first pivot arm means, and said second pivot arm means; and bulk liquid carrier connector means affixed to the other end of said flexible conductor whereby said liquid connector means may be engaged with, or disengaged from, said bulk carrier by horizontal rotation of said loading arm assembly about said vertical standpipe, and vertical and horizontal flexural movements of said flexible conduit about said radii of curvature with said first and second pivotal arm means, respectively.

4. A loading arm in accordance with claim 3 wherein said pivot point supported by said horizontal support means is displaced from the connection of said flexible conduit to said elbow means sufficiently to maintain the tangency of said conduit to said elbow connection for a distance of at least twice the diameter of said conductor thereby to prevent sharp deflection of said conduit relative to said elbow means when said first pivot arm means pivots about said pivot point.

5. A bottom loading system for a tank truck which comprises:

a loading hose having one end connected to a rotatable elbow means mounted on the upper end of a standpipe, the other end of said standpipe being connectable to a liquid storage tank;

said loading hose extending horizontally outward from said one end to a generally upwardly deflectable portion over a large radius of curvature relative to the diameter of said hose to a central portion forming a transition section into a vertically pendant portion, the radius of curvature of said central portion also being large relative to said diameter, and the other end of said hose terminating in a tank truck valve connector;

means for supporting said portions of said loading hose which includes horizontal arm means secured to said elbow means for rotation therewith about the axis of said standpipe, a first pair of articulated arm members supported on opposite sides of said hose by first pivot means mounted adjacent the outer end of said horizontal arm means, said first pivot means being positioned between said one end and said central portion of said hose, a second pair of articulated arm members supported on opposite sides of said hose by other pivot means mounted adjacent one end of said first pair of articulated arm members and forward of said central portion of said hose, and means for securing the pendant ends of said second pair of articulated arm members to said hose adjacent the upper end of said vertically pendant portions of said hose; and means for connecting the other end of said hose to a loading valve of a tank truck.

* * * * *